US007237418B2

(12) United States Patent
Maeno et al.

(10) Patent No.: US 7,237,418 B2
(45) Date of Patent: Jul. 3, 2007

(54) METHOD OF EXTRUDING HOLLOW LIGHT METAL MEMBER, DIE FOR EXTRUDING HOLLOW LIGHT METAL, AND MEMBER FOR EXTRUDING HOLLOW LIGHT METAL

(75) Inventors: Sumihiko Maeno, Kobe-shi (JP); Akira Sakae, Kobe-shi (JP)

(73) Assignee: Kabushiki Kaisha Kobe Seiko Sho (Kobe Steel, Ltd.), Kobe-shi (JP)

( * ) Notice: Subject to any disclaimer, the term of this patent is extended or adjusted under 35 U.S.C. 154(b) by 0 days.

(21) Appl. No.: 10/556,800

(22) PCT Filed: May 11, 2004

(86) PCT No.: PCT/JP2004/006601

§ 371 (c)(1),
(2), (4) Date: Nov. 15, 2005

(87) PCT Pub. No.: WO2004/103596

PCT Pub. Date: Dec. 2, 2004

(65) Prior Publication Data

US 2006/0207308 A1 Sep. 21, 2006

(30) Foreign Application Priority Data

May 23, 2003 (JP) ..... 2003-146839

(51) Int. Cl.
*B21C 25/04* (2006.01)
*B21K 5/20* (2006.01)

(52) U.S. Cl. ..... 72/269; 72/467; 76/107.1

(58) Field of Classification Search ..... 72/253.1, 72/269, 271, 467; 76/107.1, 107.6; 700/196, 700/204

See application file for complete search history.

(56) References Cited

U.S. PATENT DOCUMENTS

| | | | | |
|---|---|---|---|---|
| 3,520,168 | A * | 7/1970 | Braeuninger | 72/269 |
| 3,575,030 | A * | 4/1971 | Braeuninger | 72/269 |
| 4,425,374 | A * | 1/1984 | McCutcheon, Sr. | 427/487 |
| 5,296,190 | A * | 3/1994 | Premkumar | 420/550 |
| 6,233,500 | B1 * | 5/2001 | Malas et al. | 700/204 |

FOREIGN PATENT DOCUMENTS

| | | |
|---|---|---|
| JP | 2002-18515 | 1/2002 |
| JP | 2003-13191 | 1/2003 |

* cited by examiner

*Primary Examiner*—Ed Tolan
(74) *Attorney, Agent, or Firm*—Oblon, Spivak, McClelland, Maier & Neustadt, P.C.

(57) ABSTRACT

It is an object to realize and establish new extrusion technology for manufacturing a light-metal hollow member (product) having excellent mechanical properties with constant stability and also efficiently manufacturing the product having a strength satisfying a required level at low cost, by using a hollow die such as a bridge die. The object is achieved by dividing and joining/welding a light-metal material with a hollow extrusion die and then extruding the light-metal material to form in a desired cross-sectional shape through a die opening, wherein the strain level applied to the light-metal material after the joining/welding is maintained at 1.8 or more and the extrusion is performed.

6 Claims, 6 Drawing Sheets

METHOD OF EXTRUDING HOLLOW LIGHT METAL MEMBER, DIE FOR EXTRUDING HOLLOW LIGHT METAL, AND MEMBER FOR EXTRUDING HOLLOW LIGHT METAL

This application is a 35 U.S.C. 371 of PCT/JP04/06601 filed May 11, 2004.

TECHNICAL FIELD

The present invention relates to manufacturing technology of hollow members (products) made of light-metal such as aluminum by extrusion processes. Specifically, the present invention relates to extrusion technology for preparing hollow members having a variety of cross-sectional shapes from light-metal solid materials.

BACKGROUND ART

Conventional methods for manufacturing a hollow member made of light-metal such as an aluminum base alloy by hot extrusion are known, such as a method shown in FIG. 5. In this method, a light-metal material 1 molded into a solid billet is fed into a container 2 of an extruder under heating; a pressure is applied from the back (from the direction shown by an arrow A in the drawing) of the light-metal material 1 by a stem 3; and the light-metal material 1 is extruded from a die opening having a predetermined cross-sectional shape to the front (to the direction shown by an arrow B in the drawing) through a couple of hollow dies 4 provided in a die-holder 9 continuing to the container 2. Thus, a product of the hollow member 5 (a rectangular tube in this drawing example) is prepared.

In this method, a hollow die such as a bridge die, a porthole die, or a spider die is used as the couple of hollow dies 4. The porthole die as an example of the hollow die is shown in FIG. 6.

The couple of hollow dies 4 has an internal die 4*a* positioned at the billet side and an external die 4*b* positioned at the hollow member 5 side. Both dies 4*a* and 4*b* are fit to each other and used in an integrated manner.

The internal die 4*a* includes a plurality of entry ports 6 (the example in the drawing has four entry ports, but one of them is not shown) perforated at a peripheral portion thereof and includes an internal bearing 7*a* (mandrel) which protrudes toward the downstream direction (the external die 4*b* side) in the extrusion at the central portion. The external die 4*b* is provided with a recessed welding chamber 8 having an approximate cross shape corresponding to the respective entry ports 6 of the internal die 4*a*. The welding chamber 8 has an external bearing 7*b* of a hole passing through the external die 4*b* in the axial direction at the central part. The external bearing 7*b* is formed into a shape so that a gap with a specified shape (a thin-walled rectangular tube in this drawing example) can be formed when the internal bearing 7*a* of the internal die 4*a* is inserted into the external bearing 7*b*. Thus, the hollow member 5 having a cross-section corresponding to the gap shape can be prepared by extrusion.

The mechanism of extrusion using the couple of hollow dies 4 will be briefly described with reference to FIG. 6. The light-metal material 1 is pushed from the direction of the arrow A and is pressed into the four entry ports 6 of the external die 4*b* so as to be divided and to flow in the respective entry ports 6. Namely, the light-metal material 1 is divided into four parts 1*a*, 1*b*, 1*c*, and 1*d*. The divided parts 1*a* to 1*d* converge at the welding chamber 8 of the external die 4*b* after passing through the entry ports 6 and are welded to be unified again. The unified light-metal material 1 is extruded from a gap between the external face of the internal bearing 7*a* having a rectangular cross-section and the internal face of the external bearing 7*b* having a rectangular cross-section for receiving the internal bearing 7*a* with the gap in the direction of the arrow B. As a result, the hollow member (rectangular tube) 5 having a rectangular hollow cross-section corresponding to the gap shape is formed. Therefore, the resulting hollow member 5 has four edges of welding portions 5*a*.

Namely, since the product of the hollow member 5 prepared by this method is extruded through the processes of dividing joining/welding which are not performed in a general method using a solid die, the hollow member 5 necessarily has the welding portions 5*a* corresponding to the number and position of the entry ports 6 of the couple of hollow dies 4. The metallurgical welding adhesion between the welding portions and bearing portions (non-welded portions) influences mechanical properties, such as tensile strength, proof stress, and elongation, of the hollow member, in particular, largely influences strength. Defects in the welding adhesion of the welding portions causes fracture and deformation during secondary fabrication or in use thereafter; thus, the quality may not be sufficiently guaranteed.

The extrusion using the bridge die has an advantage of that the bridge die has a life cycle longer than that of other hollow dies, but has a disadvantage of that the operation for ensuring the strength of the welding portions is difficult. For example, an aluminum base alloy can be used without causing problems in some products which are not required to have relatively high strength, such as JIS-3000 series and JIS-6000 series. However, in products which are required to have high strength, such as JIS-7000 series, it is very difficult to ensure enough strength of the welding portions because of the metallurgical properties of the aluminum base alloy. Furthermore, in the case of JIS-5000 series, it is believed in this field that the extrusion using the hollow die is impossible. Thus, even development has been abandoned.

In cooperation with such conventional conditions, no method suitable for previously evaluating the strength of the welding portions exists. Actually, the strength cannot be confirmed until a test such as a tube expansion test after the manufacturing is performed. Therefore, the lack of strength often occurs in products, and the yield ratio is low, which is a problem. When the lack of strength is found, the die shape or extruding conditions are altered according to experimental knowledge or trial and error. Such countermeasures lack in repeatability and versatility and cannot sufficiently and rapidly respond to new product shapes and prescribed properties manufactured for the first time. Furthermore, the fabricated dies are useless, which is extremely inefficient.

The present invention has been accomplished under such circumstances. It is an object of the present invention to realize and establish new extrusion technology for stably manufacturing a light-metal hollow member (product) having excellent mechanical properties by solving all the basic problems relating to strength of the welding portions in the extrusion using a hollow die such as a bridge die, and also efficiently manufacturing the product having a strength satisfying a required level at low cost.

DISCLOSURE OF INVENTION

In order to achieve the object, the following configuration is adopted in the present invention.

Namely, the present invention relates to a method for extruding a light-metal material using a hollow extrusion die. The method includes a process for dividing the light-metal material once and then joining them and welding with each other; and a process for extruding the light-metal material after the joining to form in a desired cross-sectional shape through a die opening of the hollow extrusion die. In the process for extruding, the strain level applied to the light-metal material after the joining/welding is maintained at 1.8 or more and the extrusion is performed.

The term "strain level" as used herein means an average of equivalent strain level distribution generated in the light-metal material from the cross-section at the welding chamber to the product cross-section at the die outlet.

The tensile strength of the welding portions in a product can be increased to a level close to that of bearing portions by maintaining the strain level at 1.8 or more.

This method can be applied to a variety of light-metal materials. In particular, it is efficient when the metal constituting the light-metal member is an aluminum base alloy.

The present invention relates to extrusion of a light-metal hollow member by extruding a light-metal material using a hollow extrusion die after dividing and joining/welding the light-metal material so as to have a desired cross-sectional shape. The extrusion of the light-metal material is performed by examining a correlation between the strain level applied to the light-metal material after the joining/welding and the welding strength of the welding portions of a product after the extrusion; determining a strain level corresponding to a target welding strength on the basis of the correlation as a target strain level; and maintaining the strain level applied to the light-metal material after the joining/welding at the target strain level or more.

Furthermore, the present invention relates to a hollow extrusion die used for extrusion of a light-metal hollow member having a desired cross-sectional shape by extruding a light-metal material after dividing and joining/welding. The hollow extrusion die is designed so that the extrusion can be performed while a strain level applied to the light-metal material after the joining/welding can be maintained at 1.8 or more.

Preferably, the hollow extrusion die is a bridge die, a porthole die, or a spider die.

Furthermore, the present invention relates to a light-metal hollow member prepared by extruding a light-metal material so as to have a desired cross-sectional shape after the dividing and joining/welding of the light-metal material. The light-metal hollow member is prepared by maintaining a strain level applied to the light-metal material after the joining/welding at 1.8 or more and performing the extrusion, and the strength of the welding portions is 90% or more of that of bearing portions.

BEST MODE FOR CARRYING OUT THE INVENTION

The principles, functions, and preferable embodiments will now be described in detail.

The inventors have conducted experiments and investigated by focusing on factors influencing the strength of the welding portions in order to overcome the aforementioned problems. As a result, it has been found that the strength is quantitatively controlled by the strain level which the light-metal material receives at a particular portion of the hollow die instead of the product temperature which is generally thought. Furthermore, the inventors have advanced the research to experimentally find that when the strain level exceeds a certain threshold, the strength of the welding portions is improved to a level close to that of the bearing portions (non-welded portions). It has been revealed that a high-quality hollow member having high weld strength can be prepared and, additionally, hollow members satisfying various requirements of strength level can be unrestrainedly manufactured by quantifying the relationship between the strain level and the shape and configuration of the hollow die on the basis of these facts and by incorporating the results into the design of the die.

In order to clarify the influence of the strain level on the welding strength, the inventors have first investigated changes in the cross-sectional area of a billet material to know how the pressurized billet material in a container is deformed on the course of being extruded as a product through a hollow die.

Figure 1A:
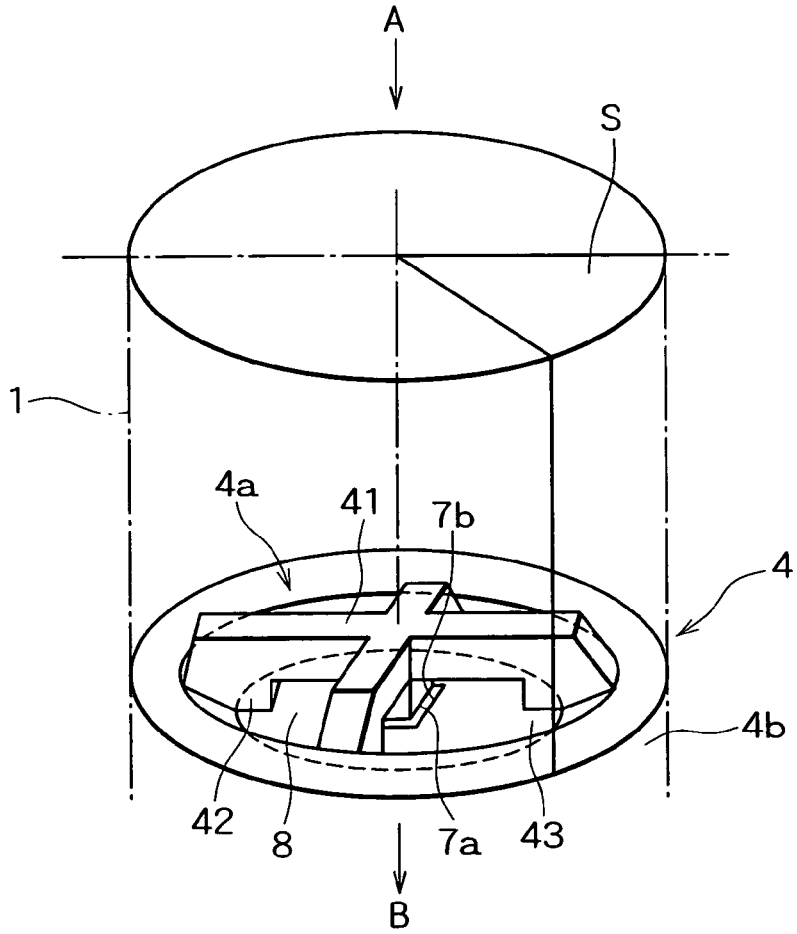
FIG. 1(*a*) is a perspective view of an example of a hollow die used in hollow extrusion, and FIG. 1(*b*) is a cross-sectional front view of the die.
Figure 1B:
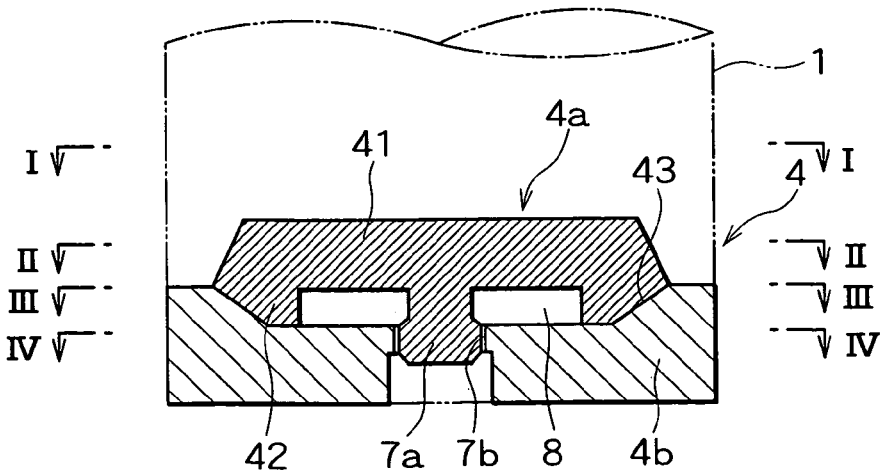
Figure 2A:
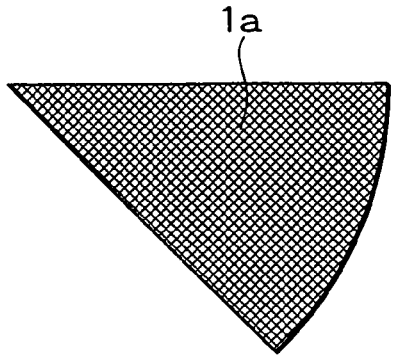
FIG. 2 is a cross-sectional plan view showing changes in cross-sectional area of a molding material at the respective positions of the hollow die.
Figure 2B:
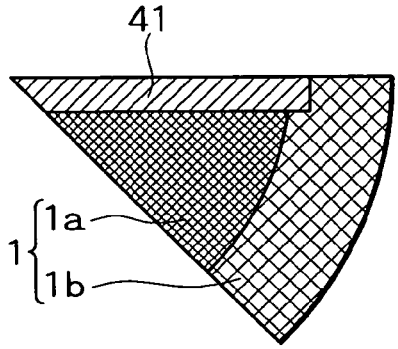
Figure 2C:
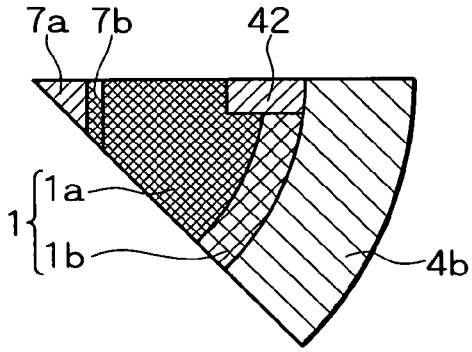
Figure 2D:
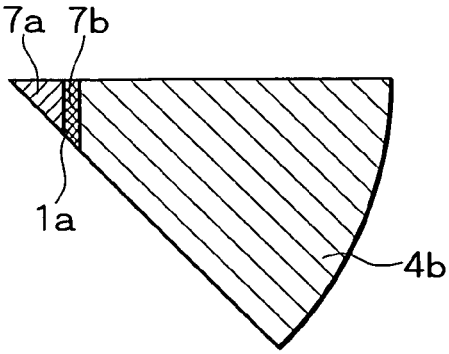

FIGS. 1(*a*) and (*b*) show an example of a bridge-type die 4. FIG. 2(*a*) to (*d*) show regions at each position of the die where metal (a molding material to be molded into a billet) lies, namely, typically show a cross-sectional shape of the metal. In these drawings, the peripheral outer wall and other members of the die 4 are omitted for easy viewing.

The die 4 includes an internal die 4*a* and an external die 4*b* which fit to each other. The internal die 4*a* includes a bridge body 41 having a cross shape and legs 42*b* protruding downward from four ends of the bridge body 41 in an integrated manner, and an internal bearing 7*a* protrudes downward from the central portion of the bridge body 41. The top face of the external die 4*b* includes a concave 43 for receiving the legs 42 of the internal die 4*a*. The concave 43 is provided with an external bearing 7*b* of a hole passing through the external die 4*a* in the axial direction at the central position of the bottom face. Relative relationship between both bearing 7*a* and 7*b* is similar to that shown in FIG. 5 and FIG. 6.

Figure 5:
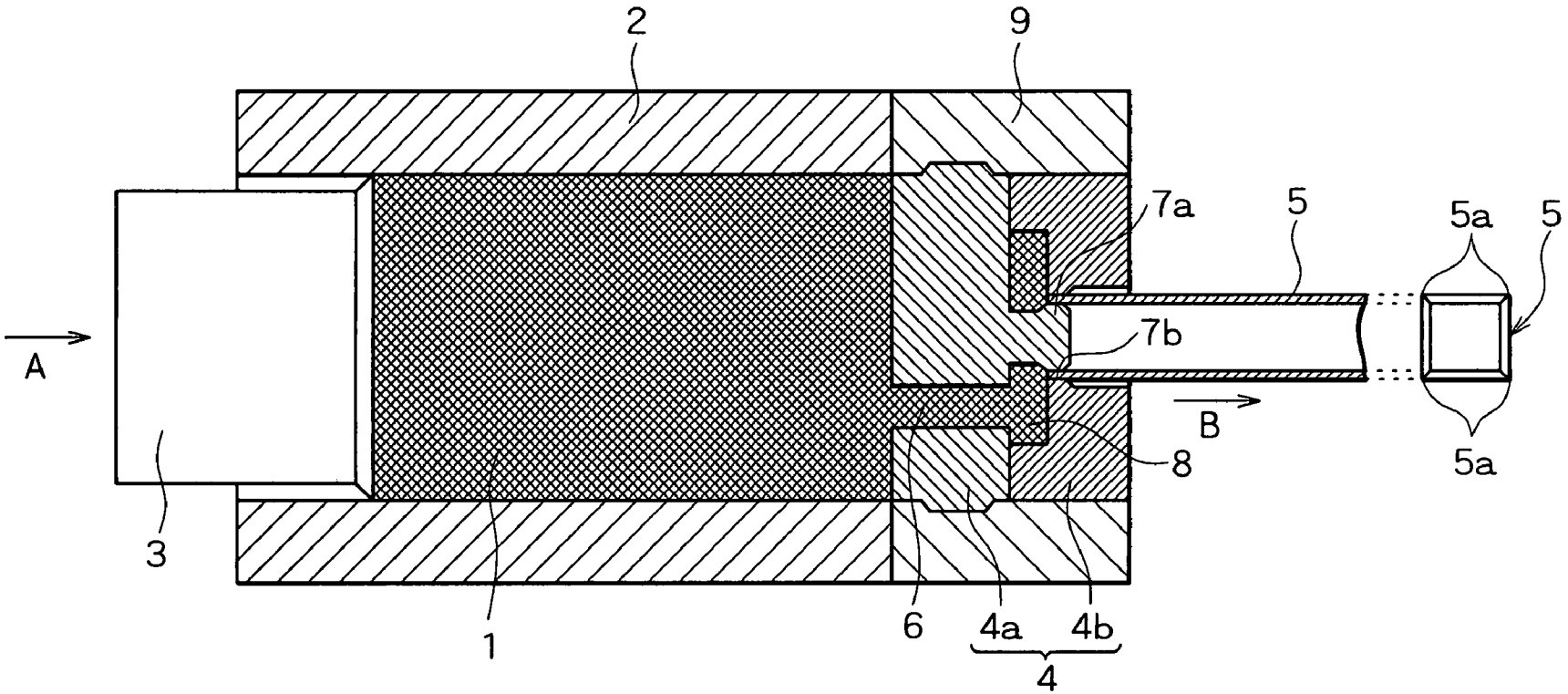
FIG. 5 is a schematic explanatory cross-sectional view of a hollow-extrusion apparatus.
Figure 6:
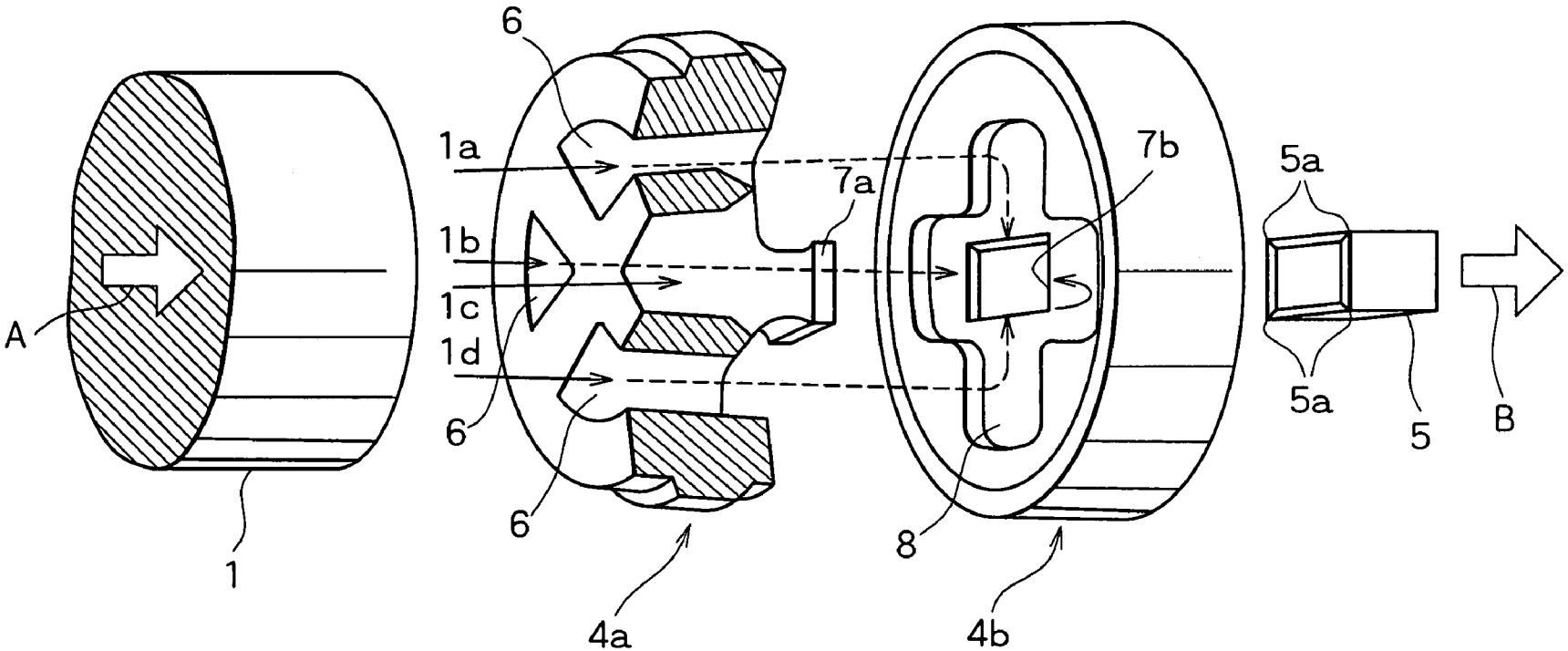
FIG. 6 is a partial cross-sectional perspective view of an example of a hollow die used in the hollow-extrusion apparatus.

In the die 4, as in the apparatus shown in FIG. 5, the cross-sectional shape of a light-metal material 1 is significantly changed during that the light-metal material 1 molded into a billet is fed into the container from the direction of the arrow A and then is finally extruded as a product to the direction of the arrow B. FIG. 2 shows the transition of the cross-sectional shape by focusing on a sector region S having a central angle of 45° shown in FIG. 1(*a*).

Specifically, FIGS. 2(*a*), (*b*), (*c*), and (*d*) show the cross-sectional shapes of the light-metal material 1 at the positions of the height of the line I—I, line II—II, line III—III, and line IV—IV, respectively, shown in FIG. 1(*b*). In the light-metal material 1, a flowing part at the central side of the die 4 and a accumulating part which the material does not flow to be left at the outside of the flowing part are generated. In FIGS. 2(*a*), (*b*), (*c*), and (*d*), the flowing part 1*a* of the light-metal material 1 is shown by fine mesh and the non-flowing part 1*b* is shown by rough mesh.

At the position of the line I—I, namely, at the position in the container above the die 4, the flowing part 1*a* of the light-metal material 1 fills the entire cross-sectional area. At the position of the line II—II, namely, at the position above the legs 42 but the bridge body 41 lies, the light-metal material 1 is divided into four parts with the bridge body 41 as shown in FIG. 2(*b*) and the divided cross-sectional area decreases corresponding to the opening area of the bridge body 41.

Then, the divided parts pass the bridge body 41 and reach the position of the line III—III where the legs 42 lie, and are joined again and welded with each other in a welding chamber 8 formed inside the legs 42 and below the bridge body 41. Therefore, the cross-sectional shape of the metal (molding material) herein is as shown in FIG. 2(*c*).

At the position of the line IV—IV where both bearings 7*a* and 7*b* lie, the cross-sectional area of the metal is controlled by the size of the gap formed between the bearings 7*a* and 7*b* as shown in FIG. 2(*d*) and significantly decreases compared to the cross-sectional area shown in FIG. 2(*c*).

The inventors have investigated the transition of the cross-sectional area as referred to above and have concluded that the strain level applied to the metal during from the portion of the welding chamber 8 after the joining as shown in FIG. 2(*c*) to the portion after the molding as shown in FIG. 2(*d*) in each of the above-mentioned positions may largely influence on the welding strength. The term "strain level" as used herein means an average of equivalent strain level distribution from the cross-section at the welding chamber to the product cross-section at the die outlet, as described above.

Figure 3A:
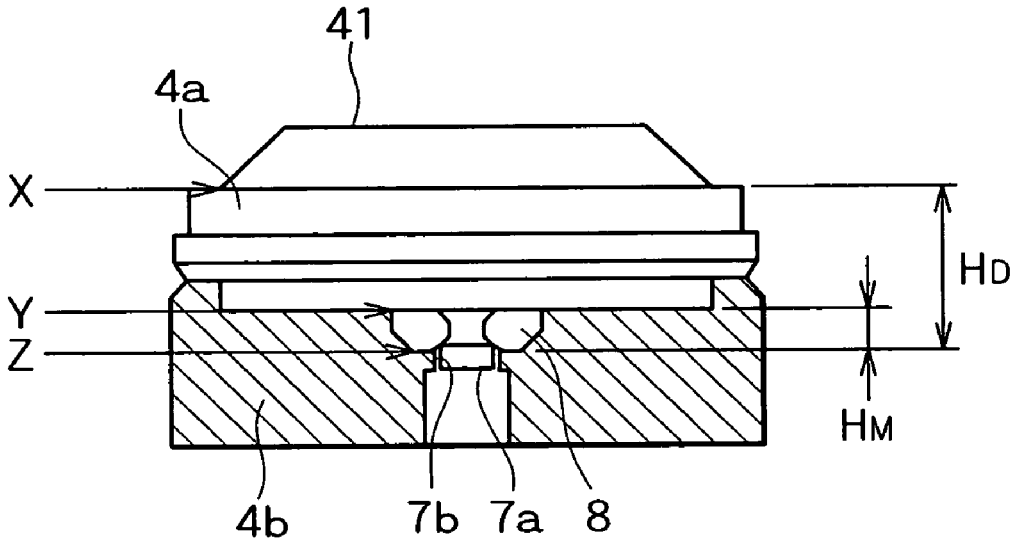
FIGS. 3(*a*) and (*b*) are partial cross-sectional front views for describing the sizes of various types of the hollow dies.
Figure 3B:
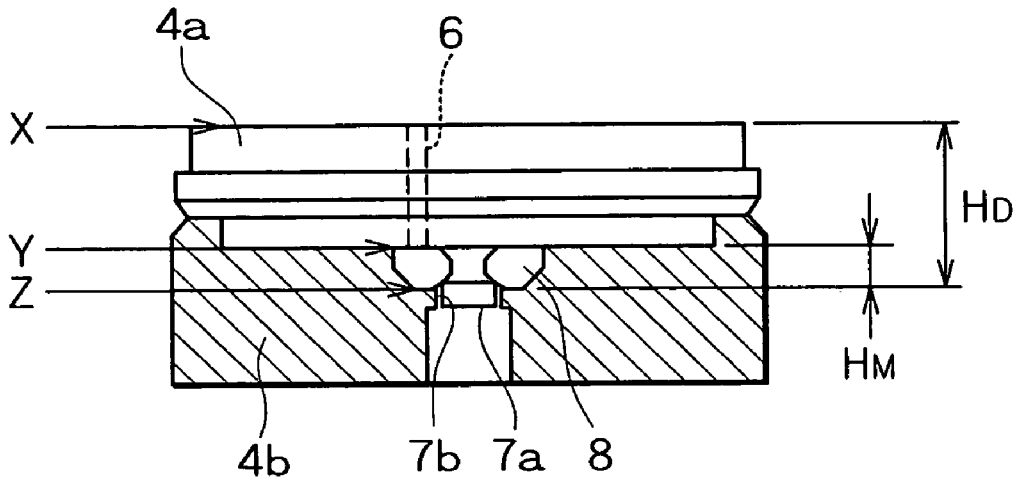

Consequently, the strain level is largely controlled by the cross-sectional area (Ae) of the light-metal material 1 in the welding chamber 8 and the cross-sectional area (Atp) of a product, and is also changed by the welding chamber height ($H_M$) and the die thickness ($H_D$) shown in FIGS. 3(*a*) and (*b*). FIG. 3(*a*) shows the dimension of a bridge die or a spider die having the bridge body 41, and FIG. 3(*b*) shows the dimension of a porthole die having an entry port 6. In these drawings, X denotes the position of a face of the entry port, Y denotes the position of the top face of the welding chamber (top face of joining portion), and Z denotes the position of a face of the die opening.

The inventors have obtained a clear conclusion that problems in the welding strength can be fundamentally solved by quantifying relationship between these die-designing factors and the strain level and designing the die on the basis of the qualified relationship. Though a specific method for the quantification (construction of formula or function) of the designing factors and the strain level is not particularly described here, with the determination of the die shape, the strain level can be calculated by utilizing known numerical analysis such as finite element analysis or difference calculus. Therefore, the correlation between the die-designing factors and the strain level can be relatively readily determined.

The inventors have investigated and examined the relationship among the welding strength, strain level, and their controlling factors. Then, in order to confirm the relationship can be effectively applied to actual technology, experimental extrusion of an aluminum base alloy such as 7000 series using as a test material was performed by using hollow dies of various shapes, and the strain level and the tensile strength of the resulting hollow member at each condition were measured. The following Table 1 shows experimental conditions, and Table 2 shows the results.

The extrusion in this experiment was performed under process conditions in which the extrusion temperature was 450 to 550° C., the extrusion force was 1500 to 3500 t, and the extrusion ratio was 10 to 140. The term "EP" in Table 1 is an abbreviation of entry port.

TABLE 1

| No. | Test material (Type of Aluminum base alloy) | Die type | Die thickness $H_D$ (mm) | Welding chamber height $H_M$ (mm) | Product cross-sectional area Atp ($mm^2$) | EP area Am($mm^2$) |
|---|---|---|---|---|---|---|
| 1 | JIS7N01 | Bridge | 145 | 35 | 1053 | 18188 |
| 2 | JIS7N01 | Entry | 160 | 30 | 4005 | 27760 |
| 3 | JIS7075 | Porthole | 185 | 35 | 4475 | 37468 |
| 4 | JIS7003 | Spider | 50 | 10 | 1906 | 15768 |
| 5 | JIS7N01 | Bridge | 30 | 20 | 255 | 9488 |
| 6 | JIS7003 | Spider | 30 | 8 | 255 | 9488 |
| 7 | JIS7N01 | Porthole | 30 | 20 | 255 | 5251 |
| 8 | JIS7075 | Bridge | 30 | 8 | 255 | 5251 |
| 9 | JIS7N01 | Bridge | 100 | 25 | 1562 | 33970 |
| 10 | JIS7075 | Porthole | 100 | 20 | 1102 | 29517 |
| 11 | JIS7N01 | Bridge | 60 | 10 | 725 | 10378 |

TABLE 2

| No. | Strain level | Tensile strength at welding portion/ tensile strength at bearing portion |
|---|---|---|
| 1 | 1.59 | Poor |
| 2 | 0.75 | Poor |
| 3 | 0.87 | Poor |
| 4 | 0.90 | Poor |
| 5 | 3.22 | Good |
| 6 | 2.37 | Good |
| 7 | 2.64 | Good |
| 8 | 1.83 | Good |
| 9 | 2.41 | Good |
| 10 | 3.15 | Good |
| 11 | 1.78 | Poor |

Table 2 shows that the tensile strength ratios in all test materials having a strain level of 1.8 or more were or more, unlike the test materials having a strain level than 1.8. It is observed that the welding strength at the welding portion does not highly different from that of the bearing portion. Therefore, excellent hollow members having the welding portions with high strength can be stably manufactured by that a threshold of the strain level is determined at 1.8 and the extrusion is performed while maintaining the strain level at the threshold or more.

Figure 4:
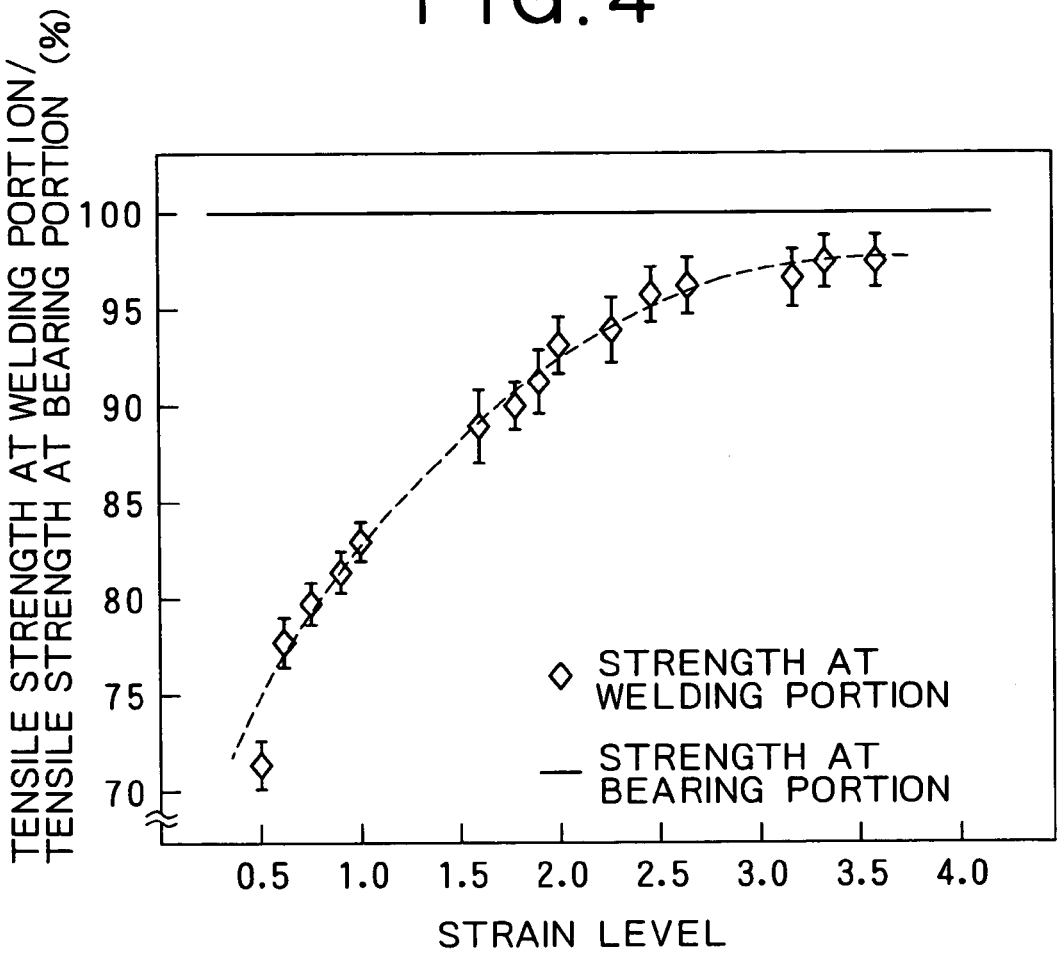
FIG. 4 is a graph showing a relationship between the strain level and the welding strength on the basis of the experimental results of extrusion using a hollow die.

FIG. 4 is a graph showing the relationship between the strain level and the welding strength when the number of the test materials are increased by adding the results of further experiments in addition to the above results. In the drawing, the solid line parallel to X-axis positioned at a tensile strength ratio between the welding portion and the bearing portion of 100% shows the tensile strength of the bearing portion (non-welding portion), and the dotted curve line shows the tensile strength of the welding portion.

With referred to the drawing, there is a clear positive correlation between the strain level and the welding strength, and when the strain level is 1.8 or more, as was expected, the strength ratio is 90% or more. Thus, it is observed that the welding portion is also excellent in strength. Furthermore, in particular, it is observed that the strain level in the range of 2.4 or more can generate the welding portion having very high strength such as a strength ratio of 95% or more, and that a hollow member of improved high quality being almost equal to strength of a bearing material can be provided. Namely, these experimental results show the strain level must be maintained at 1.8 or more during the extrusion in order to prepare the light-metal hollow member having a tensile strength ratio of 90% or more, in particular, when the strain level is maintained at 2.4 or more during the extrusion, the light-metal hollow member having high strength characteristics can be prepared.

As described above, the light-metal hollow member having sufficient welding strength can be stably prepared by examining the correlation between the strain level and the welding strength; determining a strain level corresponding to a target welding strength on the basis of the resulting correlation and using the strain level as a target strain level; designing a hollow extrusion die so that the strain level applied to the light-metal hollow material is maintained at the target strain level or more during the extrusion after the joining/welding; and performing the extrusion using the die.

In the above-mentioned embodiment, the beneficial effects of the present invention was verified by using aluminum base alloys. The present invention can be applied to the extrusion of other light-metals (including alloys), for example, tin, antimony, titanium, magnesium, and beryllium, to obtain similar effects.

The invention claimed is:

1. Extrusion of a light-metal hollow member by extruding a light-metal material using a hollow extrusion die, the extrusion comprising:

a process for dividing the light-metal material once and then joining them and welding with each other; and a process for extruding the light-metal material after the joining into a desired cross-sectional shape through a die opening of the hollow extrusion die, wherein a strain level applied to the light-metal material after the joining/welding is maintained at 1.8 or more in the process for extruding and the extrusion is performed.

2. The extrusion of a light-metal hollow member according to claim 1, wherein metal constituting the light-metal member is an aluminum base alloy.

3. Extrusion of a light-metal hollow member by extruding a light-metal material using a hollow extrusion die after dividing and joining/welding the light-metal material so as to have a desired cross-sectional shape, wherein a correlation between the strain level applied to the light-metal material after the joining/welding and the welding strength of the welding portions of a product after the extrusion is examined; a strain level corresponding to a target welding strength is determined as a target strain level on the basis of the correlation; and the strain level applied to the light-metal material after the joining/welding is maintained at the target strain level or more during the extrusion of the light-metal material.

4. A hollow extrusion die used for extrusion of a light-metal hollow member having a desired cross-sectional shape by extruding a light-metal material after dividing and joining/welding, wherein the hollow extrusion die is designed so that a strain level applied to the light-metal material after the joining/welding can be maintained at 1.8 or more and the extrusion can be performed.

5. The hollow extrusion die according to claim 4, wherein the die is a bridge die, a porthole die, or a spider die.

6. A light-metal hollow member prepared by extruding a light-metal material so as to have a desired cross-sectional shape after dividing and joining/welding the light-metal material, wherein the light-metal hollow member is prepared by maintaining a strain level applied to the light-metal material after the joining/welding at 1.8 or more and performing the extrusion; and the strength of the welding portions is 90% or more of that of bearing portions.

* * * * *